US010321789B2

(12) United States Patent
Jones et al.

(10) Patent No.: US 10,321,789 B2
(45) Date of Patent: Jun. 18, 2019

(54) MAGNETIC SHOWER CURTAIN SYSTEM

(71) Applicant: Moen Incorporated, North Olmsted, OH (US)

(72) Inventors: Kyle Clancy Jones, Avon, OH (US); Eric John Tonissen, Olmsted Township, OH (US)

(73) Assignee: Moen Incorporated, North Olmsted, OH (US)

( * ) Notice: Subject to any disclaimer, the term of this patent is extended or adjusted under 35 U.S.C. 154(b) by 0 days.

(21) Appl. No.: 15/834,751

(22) Filed: Dec. 7, 2017

(65) Prior Publication Data

US 2018/0160861 A1 Jun. 14, 2018

Related U.S. Application Data

(60) Provisional application No. 62/432,937, filed on Dec. 12, 2016.

(51) Int. Cl.

| | |
|---|---|
| ***A47K 3/38*** | (2006.01) |
| ***A47H 13/02*** | (2006.01) |
| ***A47H 23/01*** | (2006.01) |
| *A47K 3/30* | (2006.01) |

(52) U.S. Cl.

CPC ..... *A47K 3/38* (2013.01); *A47H 13/02* (2013.01); *A47H 23/01* (2013.01); *A47H 2201/01* (2013.01); *A47K 2003/305* (2013.01)

(58) Field of Classification Search

CPC ..... A47K 3/38; A47K 2003/305; A47H 2201/01; A47H 23/01; A47H 13/02

USPC ..... 4/558, 608, 610; 211/180; 160/330, 160/349.1, 349.2, DIG. 6

See application file for complete search history.

(56) References Cited

U.S. PATENT DOCUMENTS

| | | | | |
|---|---|---|---|---|
| 2,212,326 A | | 8/1940 | Piken | |
| 2,864,096 A | | 12/1958 | Garber | |
| 2,948,407 A | | 8/1960 | Wiszuk | |
| 3,000,016 A | | 9/1961 | Ridge | |
| 3,107,361 A | * | 10/1963 | Glutting, Sr. ..... | A47K 3/38 160/349.1 |
| 3,282,328 A | | 11/1966 | Mushro et al. | |

(Continued)

*Primary Examiner* — Erin Deery
(74) *Attorney, Agent, or Firm* — Calfee, Halter & Griswold LLP

(57) ABSTRACT

A magnetic shower curtain system that maintains a shower curtain in place along opposing shower enclosure walls. The magnetic shower curtain system includes a shower rod assembly, a mounting assembly, and a shower curtain assembly. The shower curtain assembly includes a plurality of shower rings. The shower rings are placed on a shower rod, connected to a shower curtain, and slid along the shower rod. The shower rings include a first outer shower ring and a second outer shower ring. One of: (1) the first outer shower ring and the second outer shower ring, and (2) a first outer end and a second outer end of the shower rod or the mounting assembly, includes a magnet. The other of: (1) the first outer shower ring and the second outer shower ring, and (2) the first outer end and the second outer end of the shower rod or the mounting assembly, includes a magnet or a magnetically attractable material. The shower curtain is maintained in place along the opposing shower enclosure walls by attraction of the magnet to the other magnet or magnetically attractable material.

20 Claims, 7 Drawing Sheets

(56) References Cited

U.S. PATENT DOCUMENTS

| | | | | |
|---|---|---|---|---|
| 3,365,684 | A | 1/1968 | Stemke et al. | |
| 4,070,735 | A * | 1/1978 | Canaday | A47K 3/38 160/349.2 |
| 4,077,072 | A * | 3/1978 | Dezura | A47K 3/38 160/349.1 |
| 4,197,616 | A * | 4/1980 | Panuski | A47K 3/38 160/349.2 |
| 4,304,174 | A | 12/1981 | Hickson et al. | |
| 4,594,741 | A | 6/1986 | Payne | |
| 5,148,580 | A | 9/1992 | Dyckow | |
| 5,398,900 | A | 3/1995 | Schober | |
| 5,524,689 | A | 6/1996 | Clark | |
| D394,357 | S | 5/1998 | Mulder | |
| 5,787,520 | A | 8/1998 | Dunbar | |
| 5,894,610 | A * | 4/1999 | Winter | A47K 3/38 4/558 |
| D419,427 | S | 1/2000 | Mulder | |
| 6,094,755 | A | 8/2000 | Matta | |
| 6,148,452 | A | 11/2000 | Kirsopp | |
| 6,154,894 | A | 12/2000 | Alexander et al. | |
| 6,189,597 | B1 * | 2/2001 | Cheng | A47H 13/02 160/330 |
| 6,292,957 | B1 | 9/2001 | Thompson | |
| 6,488,070 | B1 | 12/2002 | Cox | |
| 7,114,545 | B2 | 10/2006 | Null | |
| 7,154,363 | B2 | 12/2006 | Hunts | |
| 7,222,655 | B2 | 5/2007 | Toti | |
| 7,274,509 | B2 | 9/2007 | Choi | |
| 7,431,067 | B2 | 10/2008 | Nien | |
| 7,644,453 | B2 | 1/2010 | Dyckow | |
| 7,699,277 | B2 | 4/2010 | Bagnall | |
| 8,051,536 | B2 | 11/2011 | Konecek-Hughes | |
| 8,122,531 | B2 | 2/2012 | Li | |
| 8,205,846 | B2 | 6/2012 | Glunk | |
| 8,869,865 | B2 | 10/2014 | Roach | |
| 8,905,114 | B1 | 12/2014 | Whitaker | |
| 9,125,509 | B2 | 9/2015 | Graneto, III | |
| 9,192,267 | B2 | 11/2015 | Tsibulevskiy et al. | |
| 9,408,500 | B2 * | 8/2016 | McFall | A47K 3/38 |
| 2007/0136985 | A1 | 6/2007 | Prabhakar | |
| 2010/0032536 | A1 | 2/2010 | Eagan | |
| 2010/0050398 | A1 | 3/2010 | Gokey | |
| 2011/0192949 | A1 | 8/2011 | Zimmerman | |
| 2012/0234502 | A1 | 9/2012 | Chen | |
| 2013/0212799 | A1 | 8/2013 | Parker et al. | |
| 2015/0053817 | A1 | 2/2015 | Wartena et al. | |
| 2015/0135426 | A1 | 5/2015 | McFall | |
| 2016/0106251 | A1 | 4/2016 | Ramey | |
| 2016/0120352 | A1 | 5/2016 | Hsu et al. | |

* cited by examiner

MAGNETIC SHOWER CURTAIN SYSTEM

CROSS-REFERENCE TO RELATED APPLICATION

This application claims the benefit of U.S. Provisional Application No. 62/432,937, filed Dec. 12, 2016, the entire disclosure of which is hereby incorporated by reference.

FIELD

The present invention relates generally to a magnetic shower curtain system and, more particularly, to a magnetic shower curtain system that maintains a shower curtain in place along opposing shower enclosure walls.

BACKGROUND

Devices for maintaining shower curtains in place are known. These devices have various drawbacks.

SUMMARY

The present invention provides a magnetic shower curtain system that maintains a shower curtain in place along opposing shower enclosure walls.

In an exemplary embodiment, the magnetic shower curtain system includes a shower rod assembly, a mounting assembly, and a shower curtain assembly. The shower rod assembly includes a shower rod. The shower rod is operable to be mounted between opposing shower enclosure walls. The shower rod includes a first outer end and a second outer end. The mounting assembly is operable to be mounted on one of the opposing shower enclosure walls. The shower curtain assembly includes a first outer shower ring. The first outer shower ring is operable to be placed on the shower rod, connected to a shower curtain, and slid along the shower rod. One of: (1) the first outer shower ring, and (2) the first outer end of the shower rod or the mounting assembly, includes a magnet. The other of: (1) the first outer shower ring, and (2) the first outer end of the shower rod or the mounting assembly, includes a magnet or a magnetically attractable material. The shower curtain is maintained in place along the opposing shower enclosure walls by attraction of the magnet of one of: (1) the first outer shower ring, and (2) the first outer end of the shower rod or the mounting assembly, to the magnet or the magnetically attractable material of the other of: (1) the first outer shower ring, and (2) the first outer end of the shower rod or the mounting assembly.

In an exemplary embodiment, the magnetic shower curtain system includes a shower rod assembly, a mounting assembly, and a shower curtain assembly. The shower rod assembly includes a shower rod. The shower rod is operable to be mounted between opposing shower enclosure walls. The shower rod includes a first outer end and a second outer end. The mounting assembly includes at least one of a mounting bracket and a shower rod cover. The mounting assembly is operable to be mounted on one of the opposing shower enclosure walls. The shower curtain assembly includes a first outer shower ring. The first outer shower ring is operable to be placed on the shower rod, connected to a shower curtain, and slid along the shower rod. One of: (1) the first outer shower ring, and (2) the first outer end of the shower rod or the mounting assembly, includes a magnet. The other of: (1) the first outer shower ring, and (2) the first outer end of the shower rod or the mounting assembly, includes a magnet or a magnetically attractable material. The shower curtain is maintained in place along the opposing shower enclosure walls by attraction of the magnet of one of: (1) the first outer shower ring, and (2) the first outer end of the shower rod or the mounting assembly, to the magnet or the magnetically attractable material of the other of: (1) the first outer shower ring, and (2) the first outer end of the shower rod or the mounting assembly.

In an exemplary embodiment, the magnetic shower curtain system includes a shower rod assembly, a mounting assembly, and a shower curtain assembly. The shower rod assembly includes a shower rod. The shower rod is operable to be mounted between opposing shower enclosure walls. The shower rod includes a first outer end and a second outer end. The mounting assembly includes a mounting bracket and a shower rod cover. The mounting bracket is operable to be connected to one of the opposing shower enclosure walls. The shower rod cover is operable to cover the first outer end of the shower rod. The shower curtain assembly includes a first outer shower ring. The first outer shower ring is operable to be placed on the shower rod, connected to a shower curtain, and slid along the shower rod. One of: (1) the first outer shower ring, and (2) the first outer end of the shower rod or the mounting assembly, includes a magnet. The other of: (1) the first outer shower ring, and (2) the first outer end of the shower rod or the mounting assembly, includes a magnet or a magnetically attractable material. The shower curtain is maintained in place along the opposing shower enclosure walls by attraction of the magnet of one of: (1) the first outer shower ring, and (2) the first outer end of the shower rod or the mounting assembly, to the magnet or the magnetically attractable material of the other of: (1) the first outer shower ring, and (2) the first outer end of the shower rod or the mounting assembly.

BRIEF DESCRIPTION OF THE DRAWINGS

—FIG. 1*a* is a perspective view of the magnetic shower curtain system with a shower curtain in a partially open position, and FIG. 1*b* is a perspective view of the magnetic shower curtain system with the shower curtain in a closed position;

—FIG. 2*a* is an exploded perspective view of the shower rod assembly and the mounting assembly of the magnetic shower curtain system, FIG. 2*b* is an exploded perspective view of one end portion of the shower rod assembly and the mounting assembly of the magnetic shower curtain system, and FIG. 2*c* is an exploded perspective view of the other end portion of the shower rod assembly and the mounting assembly of the magnetic shower curtain system;

DETAILED DESCRIPTION

The present invention provides a magnetic shower curtain system that maintains a shower curtain in place along opposing shower enclosure walls.

Figure 1B:
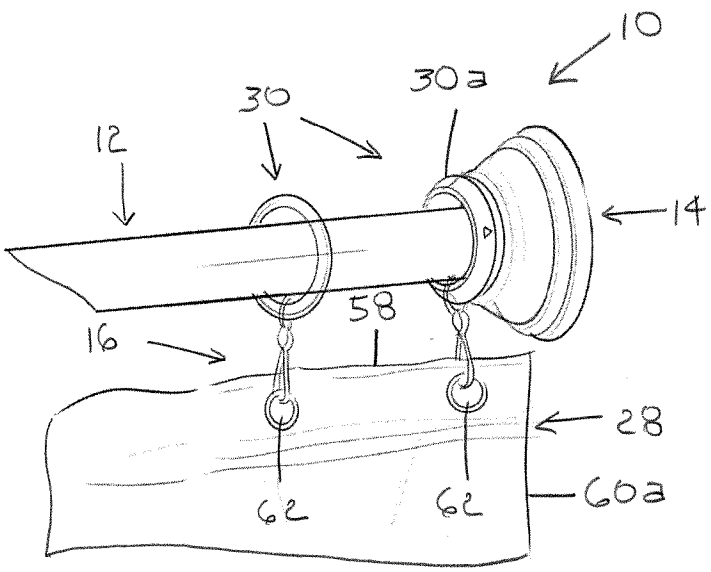
FIGS. 1*a*-1*b* are views of a magnetic shower curtain system according to an exemplary embodiment of the present invention, the magnetic shower curtain system including a shower rod assembly, a mounting assembly, and a shower curtain assembly
Figure 1A:
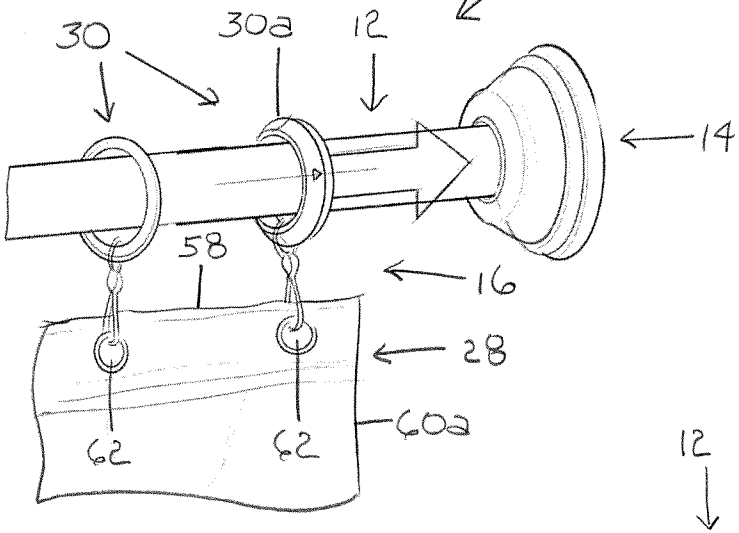
Figure 2A:
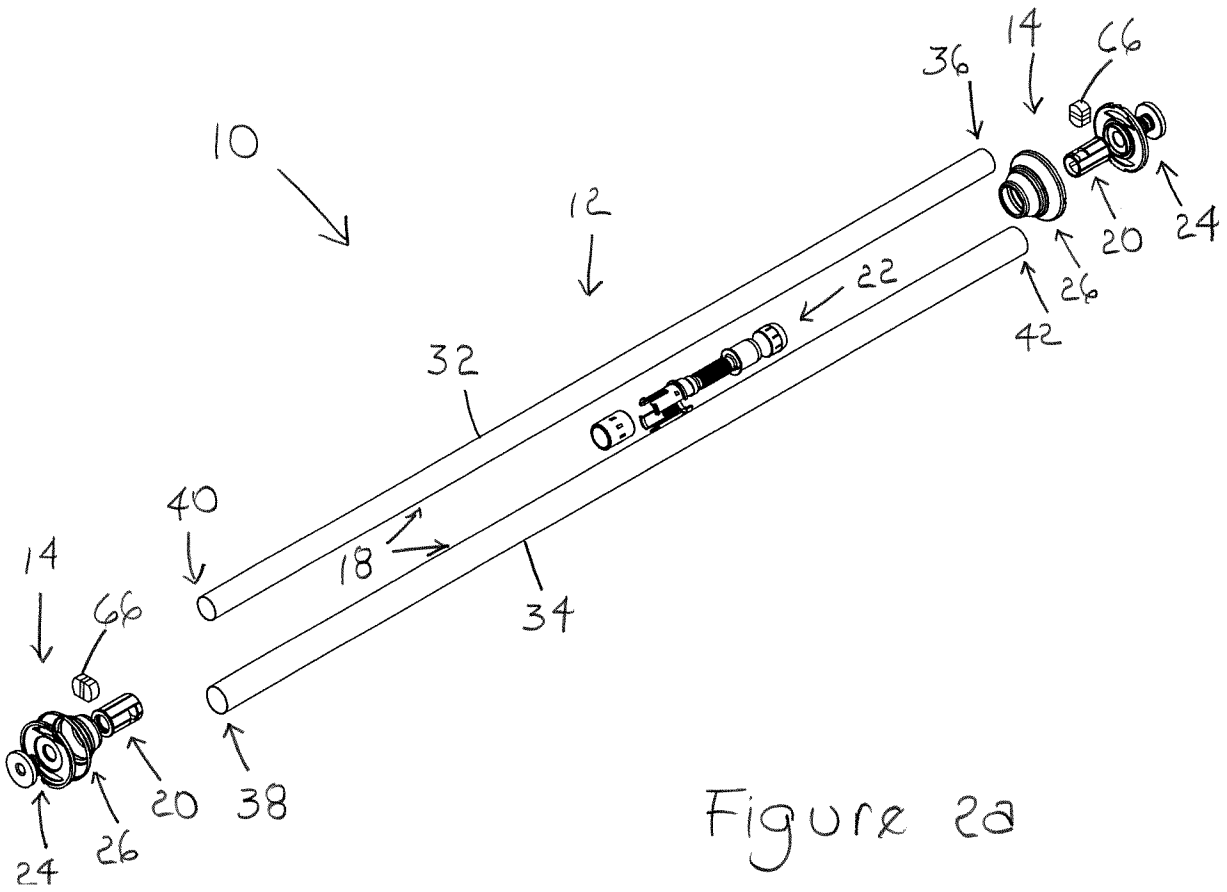
FIGS. 2*a*-2*c* are views of a shower rod assembly and a mounting assembly of a magnetic shower curtain system according to an exemplary embodiment of the present invention
Figure 2B:
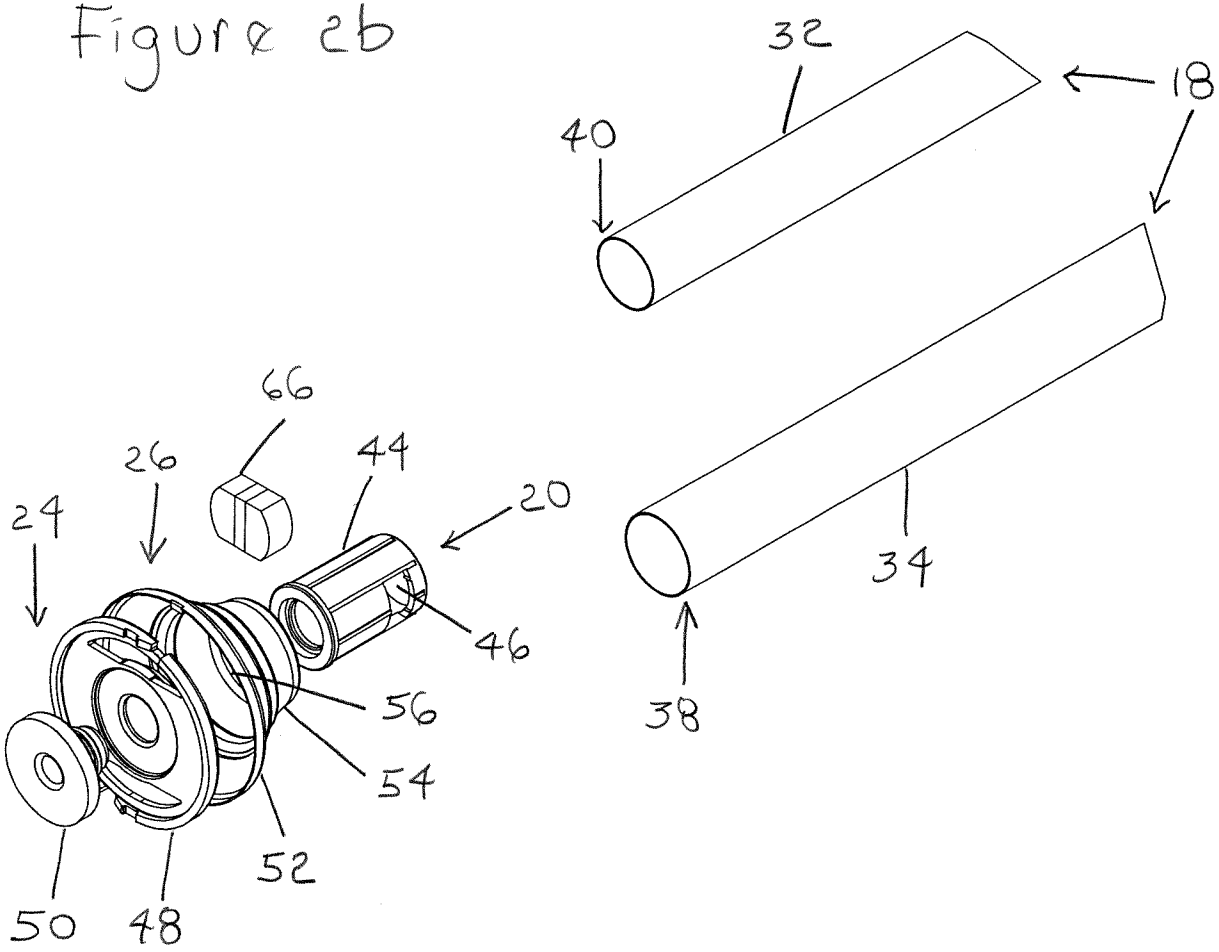
Figure 2C:
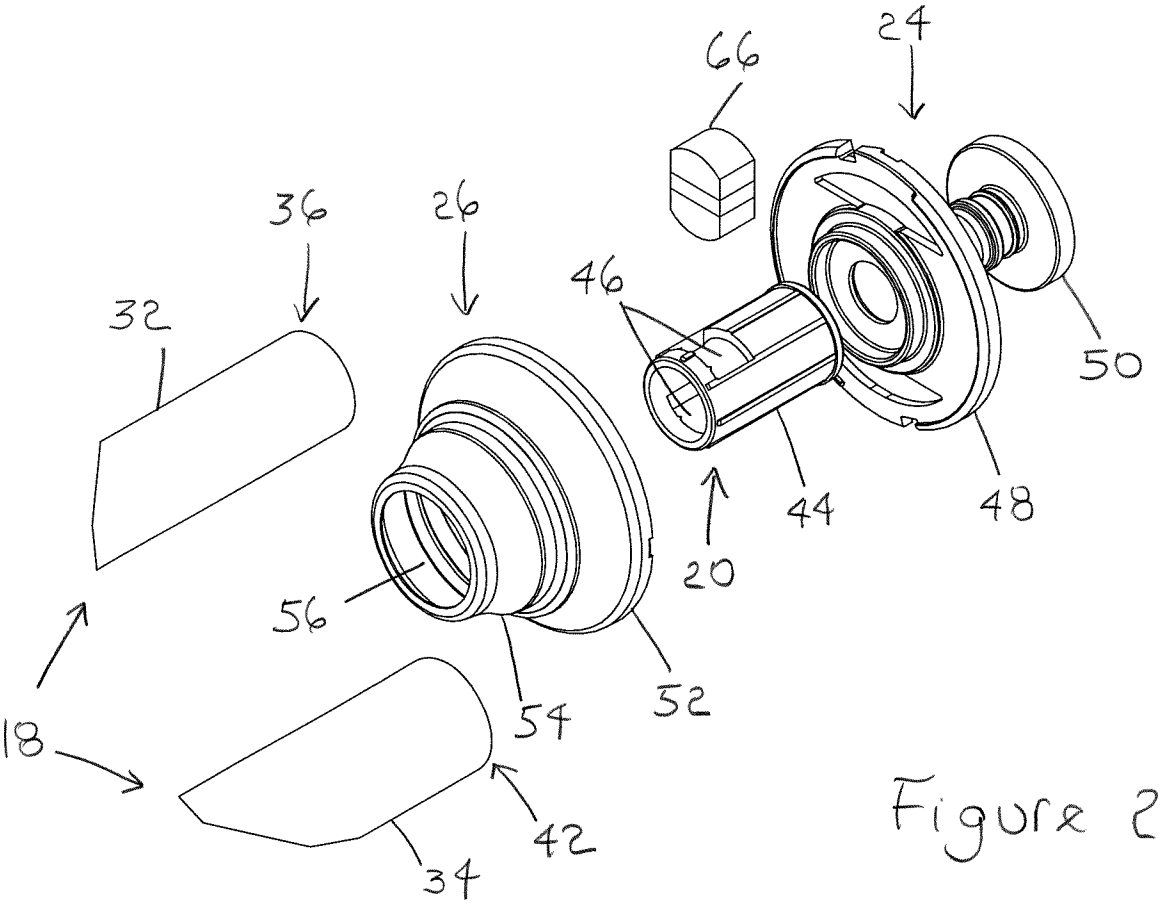
Figure 3:
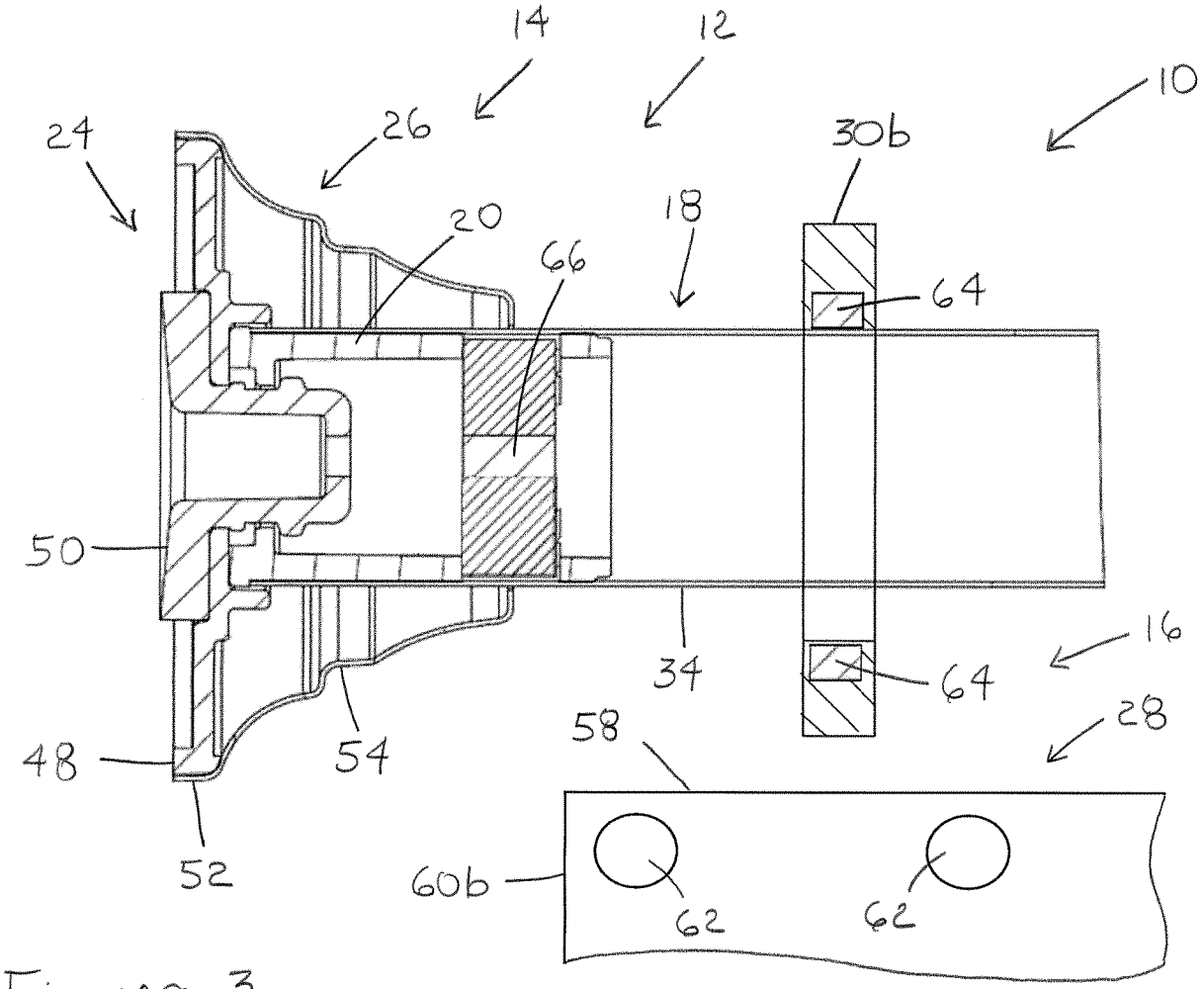
FIG. 3 is a side view, partially in cross-section, of one end portion of a magnetic shower curtain system according to an exemplary embodiment of the present invention, where a shower ring and a shower rod each include a magnet or a magnetically attractable material.
Figure 4:
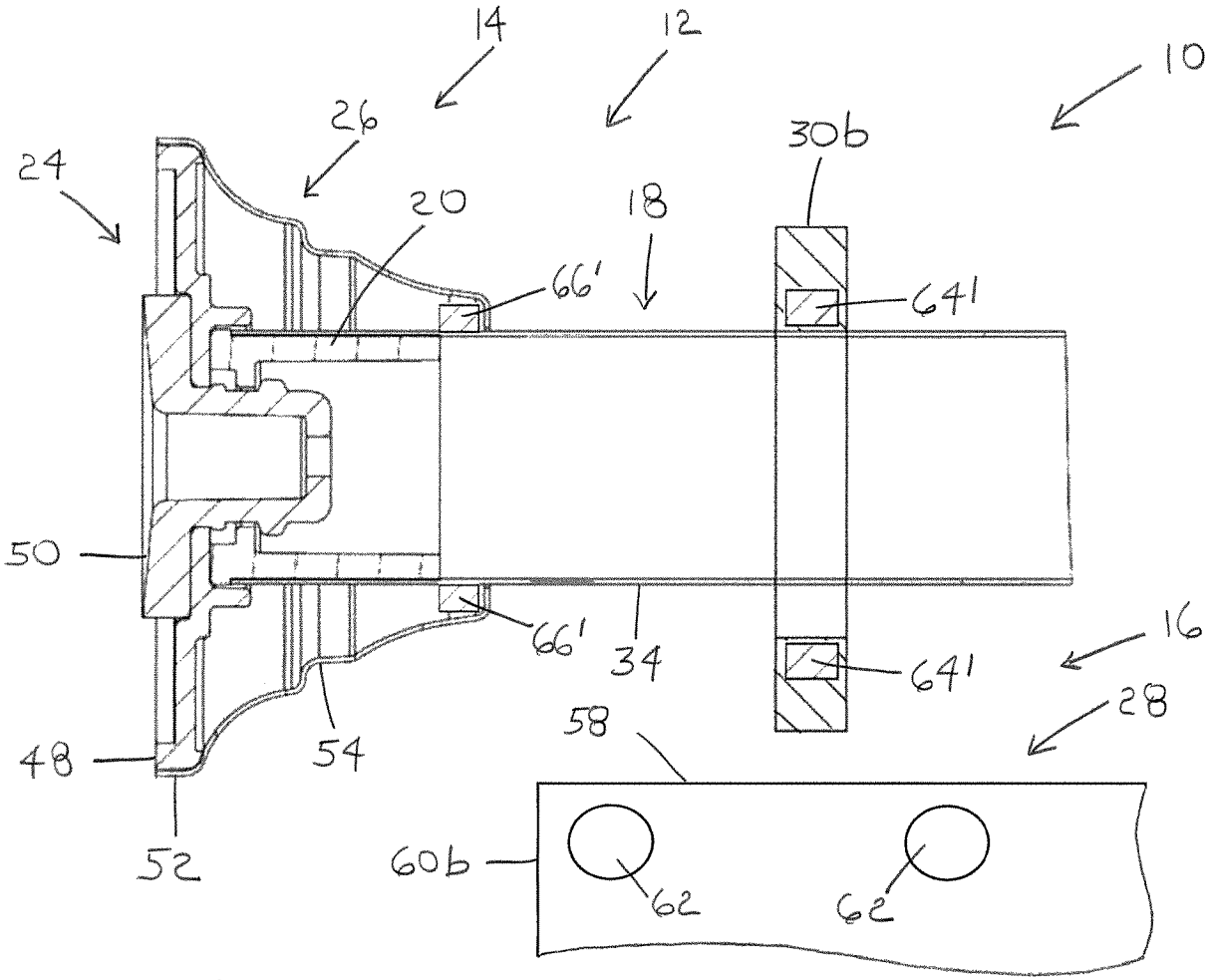
FIG. 4 is a side view, partially in cross-section, of one end portion of a magnetic shower curtain system according to an exemplary embodiment of the present invention, where a shower ring and a shower rod cover each include a magnet or a magnetically attractable material.
Figure 5:
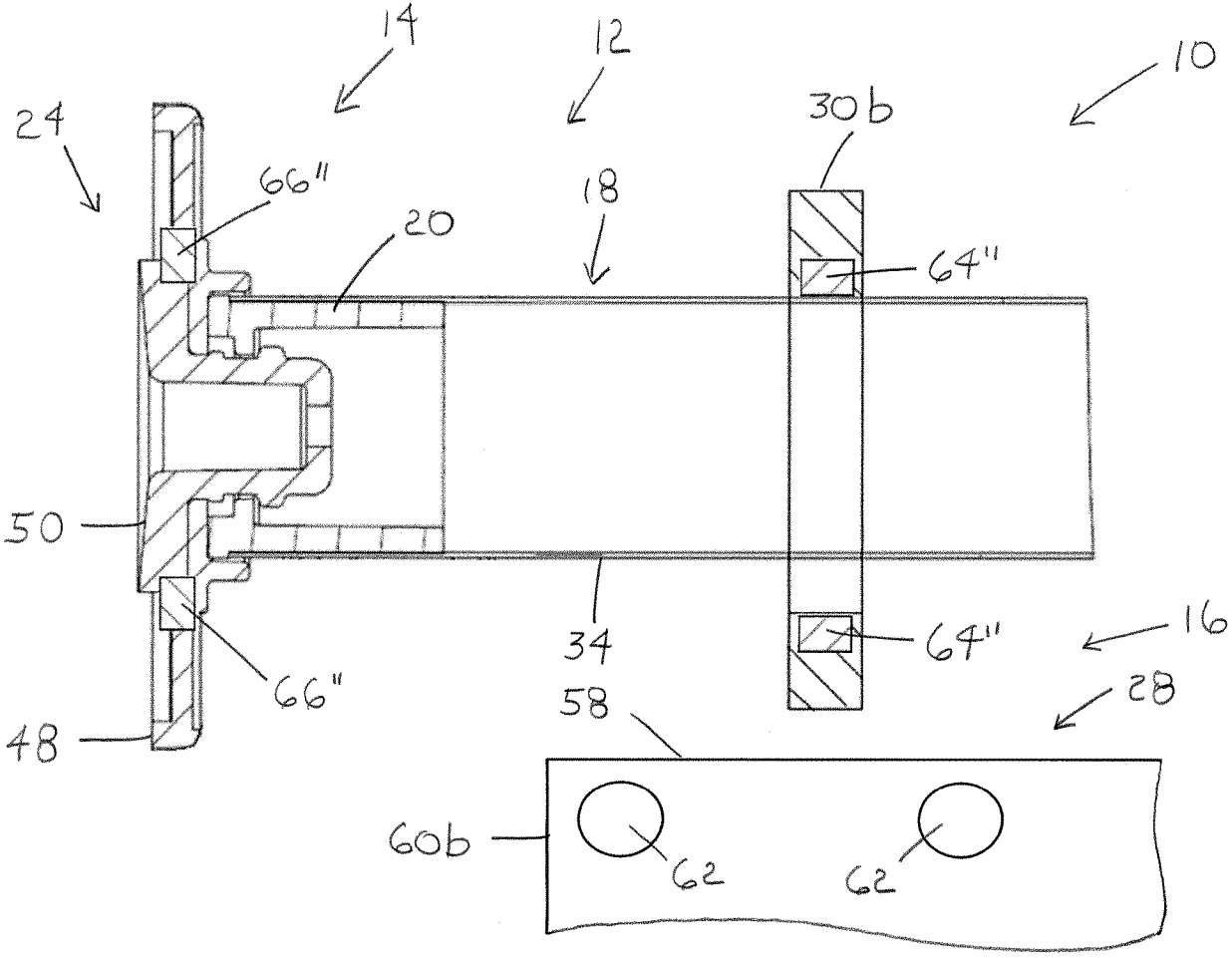
FIG. 5 is a side view, partially in cross-section, of one end portion of a magnetic shower curtain system according to an exemplary embodiment of the present invention, where a shower ring and a mounting bracket each include a magnet or a magnetically attractable material.

Exemplary embodiments of a magnetic shower curtain system 10 of the present invention are shown in detail in FIGS. 1*a*-5. In exemplary embodiments, the magnetic shower curtain system 10 includes a shower rod assembly 12, a mounting assembly 14, and a shower curtain assembly 16. In exemplary embodiments, the shower rod assembly 12 is operable to be mounted between opposing shower enclosure walls. In an exemplary embodiment, the shower rod assembly 12 includes a shower rod 18, two rod inserts 20, and a tension assembly 22. In exemplary embodiments, the mounting assembly 14 is operable to be mounted on the opposing shower enclosure walls. In an exemplary embodiment, the mounting assembly 14 includes two mounting brackets 24 and two shower rod covers 26. In exemplary embodiments, the shower curtain assembly 16 is operable to be hung between the opposing shower enclosure walls. In an exemplary embodiment, the shower curtain assembly 16 includes a shower curtain 28 and a plurality of shower rings 30.

Exemplary embodiments of the shower rod 18 are shown in detail in FIGS. 1*a*-5. In exemplary embodiments, the shower rod 18 is operable to be mounted between the opposing shower enclosure walls. In an exemplary embodiment, the shower rod 18 includes an inner tube 32 and an outer tube 34. The inner tube 32 is operable to telescopically slide within the outer tube 34 to provide an adjustable length. However, one of ordinary skill in the art will appreciate that the shower rod 18 could include a single tube that provides a fixed length. The shower rod 18 includes a first outer end 36 and a second outer end 38. In an exemplary embodiment, the inner tube 32 includes the first outer end 36 and a first inner end 40, and the outer tube 34 includes the second outer end 38 and a second inner end 42. However, one of ordinary skill in the art will appreciate that the single tube could include the first outer end 36 and the second outer end 38. In an exemplary embodiment, the first outer end 36 and the second outer end 38 of the shower rod 18 are operable to be connected to the mounting brackets 24. However, one of ordinary skill in the art will appreciate that the first outer end 36 and the second outer end 38 of the shower rod 18 could be connected to other components of the mounting assembly 14. In an exemplary embodiment, the shower rod 18 is straight. However, one of ordinary skill in the art will appreciate that the shower rod 18 could be curved, angled, or partially curved or angled. In an exemplary embodiment, the shower rod 18 is hollow. However, one of ordinary skill in the art will appreciate that the shower rod 18 could be solid or partially solid. In an exemplary embodiment, the shower rod 18 has a generally circular cross-sectional shape. However, one of ordinary skill in the art will appreciate that the shower rod 18 could have other cross-sectional shapes, such as oval, square, or rectangular. In an exemplary embodiment, the shower rod 18 is rigid. However, one of ordinary skill in the art will appreciate that the shower rod 18 could be flexible.

Exemplary embodiments of the rod inserts 20 are shown in detail in FIGS. 2*a*-5. In exemplary embodiments, the rod inserts 20 are operable to connect the first outer end 36 and the second outer end 38 of the shower rod 18 to the mounting brackets 24. In an exemplary embodiment, each rod insert 20 is operable to be inserted into and retained in one of the first outer end 36 and the second outer end 38 of the shower rod 18. In an exemplary embodiment, the rod insert 20 is generally cylindrical shaped. In an exemplary embodiment, the rod insert 20 includes an outer wall 44 with two radial openings 46 extending therethrough. In an exemplary embodiment, the radial openings 46 in the outer wall 44 of the rod insert 20 are operable to receive a magnet or a magnetically attractable material. However, one of ordinary skill in the art will appreciate that the magnet or the magnetically attractable material could be connected to the rod insert 20 by any connecting mechanism, such as adhesive or an interference fit. Further, one of ordinary skill in the art will appreciate that the magnet or the magnetically attractable material could be connected directly to the first outer end 36 and the second outer end 38 of the shower rod 18 without the rod insert 20.

Exemplary embodiments of the mounting brackets 24 are shown in detail in FIGS. 2*a*-5. In exemplary embodiments, the mounting brackets 24 are operable to be connected to the opposing shower enclosure walls. In an exemplary embodiment, each mounting bracket 24 includes a bracket plate 48 and a bracket base 50. In an exemplary embodiment, the bracket plate 48 is operable to be connected to one of the opposing shower enclosure walls by a tension fit. However, one of ordinary skill in the art will appreciate that the bracket plate 48 could be connected to one of the opposing shower walls by any connecting mechanism, such as fasteners, adhesive, and suction cups. In an exemplary embodiment, the bracket base 50 is operable to be connected to one of the first outer end 36 and the second outer end 38 of the shower rod 18.

Exemplary embodiments of the shower rod covers 26 are shown in detail in FIGS. 1*a*-5. In exemplary embodiments, the shower rod covers 26 are operable to be connected to the mounting brackets 24. In an exemplary embodiment, each shower rod cover 26 includes a cover base 52 and a cover dome 54. In an exemplary embodiment, the cover base 52 is operable to be connected to one of the bracket plates 48 of the mounting brackets 24. In an exemplary embodiment, the cover dome 54 includes an opening 56 therein. In an exemplary embodiment, the cover dome 54 is operable to receive one of the first outer end 36 and the second outer end 38 of the shower rod 18 through the opening 56 therein and to cover one of the first outer end 36 and the second outer end 38 of the shower rod 18.

An exemplary embodiment of the shower curtain 28 is shown in detail in FIGS. 1*a*-1*b* and 3-5. In an exemplary embodiment, the shower curtain 28 is operable to be hung from the shower rod 18 between the opposing shower enclosure walls. The shower curtain 28 includes a top edge 58, a first side edge 60*a*, and a second side edge 60*b*. In an exemplary embodiment, the shower curtain 28 includes a mechanism along the top edge 58 to attach the shower rings 30 to the shower curtain 28. In an exemplary embodiment, the shower curtain 28 includes a plurality of holes 62 spaced along the top edge 58 for receiving the shower rings 30.

Exemplary embodiments of the shower rings 30 are shown in detail in FIGS. 1*a*-1*b* and 3-5. In exemplary embodiments, the shower rings 30 are operable to be placed on the shower rod 18 and connected to the top edge 58 of the shower curtain 28 between the first side edge 60*a* and the second side edge 60*b* of the shower curtain 28. Additionally, the shower rings 30 are operable to be slid along the shower rod 18. The plurality of shower rings 30 includes a first outer shower ring 30*a* and a second outer shower ring 30*b* closest to the first outer end 36 and the second outer end 38 of the shower rod 18, respectively, and closest to the first side edge 60*a* and the second side edge 60*b* of the shower curtain 28, respectively. In an exemplary embodiment, the shower ring 30 is generally circular. However, one of ordinary skill in the art will appreciate that the shower ring 30 could be other shapes. In an exemplary embodiment, the shape of the shower ring 30 is complementary to the cross-sectional shape of the shower rod 18. For example, in the exemplary embodiment where the shower ring 30 is generally circular, the cross-sectional shape of the shower rod 18 would be generally circular. However, one of ordinary skill in the art will appreciate that the shape of the shower ring 30 does not need to be complementary to the cross-sectional shape of the shower rod 18 so long as the shower ring 30 can be placed on the shower rod 18 and slid along the shower rod 18. In an exemplary embodiment, the shower ring 30 is continuous, i.e., there are no breaks in the shower ring 30. In this case, the shower ring 30 would need to be placed on the shower rod 18 prior to the shower rod 18 being mounted between the opposing shower enclosure walls. In an exemplary embodiment, the shower ring 30 is discontinuous, i.e., there is a break in the shower ring 30. In this case, the shower ring 30 could be placed on the shower rod 18 after the shower rod 18 is mounted between the opposing shower enclosure walls. In the exemplary embodiment where the shower ring 30 is discontinuous, the shower ring 30 could include a mechanism to connect ends of the shower ring 30 to make the shower ring 30 continuous after the shower ring 30 is placed on the shower rod 18. In an exemplary embodiment, the shower ring 30 includes rolling balls on a portion of the shower ring 30.

In an exemplary embodiment, one of: (1) the first outer shower ring 30*a* and the second outer shower ring 30*b*, and (2) the first outer end 36 and the second outer end 38 of the shower rod 18, includes a magnet, and the other of: (1) the first outer shower ring 30*a* and the second outer shower ring 30*b*, and (2) the first outer end 36 and the second outer end 38 of the shower rod 18, includes a magnet or a magnetically attractable material. In an exemplary embodiment, the magnetically attractable material is steel. The shower curtain 28 is maintained in place along the shower enclosure walls by attraction of the magnet of one of: (1) the first outer shower ring 30*a* and the second outer shower ring 30*b*, and (2) the first outer end 36 and the second outer end 38 of the shower rod 18, to the magnet or the magnetically attractable material of the other of: (1) the first outer shower ring 30*a* and the second outer shower ring 30*b*, and (2) the first outer end 36 and the second outer end 38 of the shower rod 18. In the illustrated embodiment of FIG. 3, the second outer shower ring 30*b* includes a magnet or a magnetically attractable material 64, and the second outer end 38 of the shower rod 18 includes a magnet or a magnetically attractable material 66.

In an exemplary embodiment, one of: (1) the first outer shower ring 30*a* and the second outer shower ring 30*b*, and (2) the shower rod covers 26, includes a magnet, and the other of: (1) the first outer shower ring 30*a* and the second outer shower ring 30*b*, and (2) the shower rod covers 26, includes a magnet or a magnetically attractable material. In an exemplary embodiment, the magnetically attractable material is steel. The shower curtain 28 is maintained in place along the shower enclosure walls by attraction of the magnet of one of: (1) the first outer shower ring 30*a* and the second outer shower ring 30*b*, and (2) the shower rod covers 26, to the magnet or the magnetically attractable material of the other of: (1) the first outer shower ring 30*a* and the second outer shower ring 30*b*, and (2) the shower rod covers 26. In the illustrated embodiment of FIG. 4, the second outer shower ring 30*b* includes a magnet or a magnetically attractable material 64', and the shower rod cover 26 includes a magnet or a magnetically attractable material 66'.

In an exemplary embodiment, one of: (1) the first outer shower ring 30*a* and the second outer shower ring 30*b*, and (2) the mounting brackets 24, includes a magnet, and the other of: (1) the first outer shower ring 30*a* and the second outer shower ring 30*b*, and (2) the mounting brackets 24, includes a magnet or a magnetically attractable material. In an exemplary embodiment, the magnetically attractable material is steel. The shower curtain 28 is maintained in place along the shower enclosure walls by attraction of the magnet of one of: (1) the first outer shower ring 30*a* and the second outer shower ring 30*b*, and (2) the mounting brackets 24, to the magnet or the magnetically attractable material of the other of: (1) the first outer shower ring 30*a* and the second outer shower ring 30*b*, and (2) the mounting brackets 24. In the illustrated embodiment of FIG. 5, the second outer shower ring 30*b* includes a magnet or a magnetically attractable material 64", and the mounting bracket 24 includes a magnet or a magnetically attractable material 66".

As used herein, when a component of the magnetic shower curtain system 10 is described as including a magnet or a magnetically attractable material, the magnet or the magnetically attractable material could be a discrete element that is insertable into and removable from the component, a discrete element that is integrally connected to the component, or integrally formed in the component.

In an exemplary embodiment, the magnetic shower curtain system 10 is installed and used in a shower enclosure. Exemplary installation and use steps will be described.

During installation of a magnetic shower curtain system 10 including an adjustable length shower rod 18, the shower rings 30 and the shower rod covers 26 are placed on the shower rod 18 with the shower rod covers 26 closest to the first outer end 36 and the second outer end 38 of the shower rod 18 and the first outer shower ring 30*a* and the second outer shower ring 30*b* next closest to the first outer end 36 and the second outer end 38 of the shower rod 18, respectively. The mounting brackets 24 are connected to the first outer end 36 and the second outer end 38 of the shower rod 18. The first outer end 36 and the second outer end 38 of the shower rod 18 are placed on the opposing shower enclosure walls. The shower rod 18 is extended and locked in place using the tension assembly 22. The shower rod covers 26 are slid along the shower rod 18 toward the first outer end 36 and the second outer end 38 of the shower rod 18 and connected to the mounting brackets 24. The shower rings 30 are connected to the top edge 58 of the shower curtain 28 between the first side edge 60*a* and the second side edge 60*b* of the shower curtain 28 with the first outer shower ring 30*a* and the second outer shower ring 30*b* closest to the first side edge 60*a* and the second side edge 60*b* of the shower curtain 28, respectively. The magnetic shower curtain system 10 is now installed.

During installation of a magnetic shower curtain system 10 including a fixed length shower rod 18, the mounting brackets 24 are connected to the opposing shower enclosure walls. The shower rings 30 and the shower rod covers 26 are placed on the shower rod 18 with the shower rod covers 26 closest to the first outer end 36 and the second outer end 38 of the shower rod 18 and the first outer shower ring 30*a* and the second outer shower ring 30*b* next closest to the first outer end 36 and the second outer end 38 of the shower rod 18, respectively. The first outer end 36 and the second outer end 38 of the shower rod 18 are connected to the mounting brackets 24. The shower rod covers 26 are slid along the shower rod 18 toward the first outer end 36 and the second outer end 38 of the shower rod 18 and connected to the mounting brackets 24. The shower rings 30 are connected to the top edge 58 of the shower curtain 28 between the first side edge 60*a* and the second side edge 60*b* of the shower curtain 28 with the first outer shower ring 30*a* and the second outer shower ring 30*b* closest to the first side edge 60*a* and the second side edge 60*b* of the shower curtain 28, respectively. The magnetic shower curtain system 10 is now installed.

During use, to close the shower curtain 28, a user moves the first outer shower ring 30*a* and the second outer shower ring 30*b* along the shower rod 18 toward the first outer end 36 and the second outer end 38 of the shower rod 18. The user can move the shower rings 30 directly or by moving the shower curtain 28 attached to the shower rings 30. Once the first outer shower ring 30*a* and the second outer shower ring 30*b* are sufficiently close to: (1) the first outer end 36 and the second outer end 38 of the shower rod 18, (2) the shower rod covers 26, or (3) the mounting brackets 24 (whichever includes the magnet or the magnetically attractable material), the attraction between the magnet or the magnetically attractable material of the first outer shower ring 30*a* and the second outer shower ring 30*b* and the magnet or the magnetically attractable material of: (1) the first outer end 36 and the second outer end 38 of the shower rod 18, (2) the shower rod covers 26, or (3) the mounting brackets 24, maintains the first outer shower ring 30*a* and the second outer shower ring 30*b* and, thus, the shower curtain 28 attached to the shower rings 30, in place along the shower enclosure walls.

During use, to open the shower curtain 28, the user moves the first outer shower ring 30*a* and the second outer shower ring 30*b* along the shower rod 18 away from the first outer end 36 and the second outer end 38 of the shower rod 18. Again, the user can move the first outer shower ring 30*a* and the second outer shower ring 30*b* directly or by moving the shower curtain 28 attached to the shower rings 30. Once the first outer shower ring 30*a* and the second outer shower ring 30*b* are sufficiently spaced from: (1) the first outer end 36 and the second outer end 38 of the shower rod 18, (2) the shower rod covers 26, or (3) the mounting brackets 24 (whichever includes the magnet or the magnetically attractable material), there is no attraction between the magnet or the magnetically attractable material of the first outer shower ring 30*a* and the second outer shower ring 30*b* and the magnet or the magnetically attractable material of: (1) the first outer end 36 and the second outer end 38 of the shower rod 18, (2) the shower rod covers 26, or (3) the mounting brackets 24.

While the steps for installation and use of the magnetic shower curtain system 10 have been described above in a particular order, one of ordinary skill in the art will appreciate that these steps do not need to be performed in this particular order.

For example, while the step of connecting the mounting brackets 24 to the opposing shower enclosure walls with a fixed length shower rod 18 has been described before the step of placing the shower rings 30 and the shower rod covers 26 on the shower rod 18, one of ordinary skill in the art will appreciate that these steps could be reversed.

While the magnetic shower curtain system 10 has been shown and described in the illustrated embodiment with the components connected in a particular manner, one of ordinary skill in the art will appreciate that the components of the magnetic shower curtain system 10 do not need to be connected in this particular manner.

For example, while the shower rod 18 has been shown and described as being connected to the mounting brackets 24, one of ordinary skill in the art will appreciate that the shower rod 18 could be connected to the shower rod covers 26 or other components of the mounting assembly 14.

While the magnetic shower curtain system 10 has been shown and described in the illustrated embodiment as including certain components, one of ordinary skill in the art will appreciate that the magnetic shower curtain system 10 does not need to include each of these components and/or the specifics of each of these components.

For example, while the magnetic shower curtain system 10 has been shown and described as including magnetic components at both ends of the shower rod 18, one of ordinary skill in the art will appreciate that the magnetic shower curtain system 10 could include magnetic components at only one end of the shower rod 18. Similarly, while the mounting assembly 14 has been shown and described as including separate mounting brackets 24 and shower rod covers 26, one of ordinary skill in the art will appreciate that these components could be integrated into a single component or the mounting assembly 14 could include more than two components. Moreover, while the mounting brackets 24 have been shown and described as including a mounting plate and a mounting base, one of ordinary skill in the art will appreciate that these components could be integrated into a single component or the mounting bracket 24 could include more than two components.

One of ordinary skill in the art will now appreciate that the present invention provides a magnetic shower curtain system that maintains a shower curtain in place along opposing shower enclosure walls. Although the present invention has been shown and described with reference to particular embodiments, equivalent alterations and modifications will occur to those skilled in the art upon reading and understanding this specification. The present invention includes all such equivalent alterations and modifications.

What is claimed is:

1. A magnetic shower curtain system, comprising:

a shower rod assembly, the shower rod assembly including a shower rod, the shower rod operable to be mounted between opposing shower enclosure walls, the shower rod including a first outer end and a second outer end;

a mounting assembly, the mounting assembly operable to be mounted on one of the opposing shower enclosure walls; and a shower curtain assembly, the shower curtain assembly including a first outer shower ring, the first outer shower ring operable to be placed on the shower rod, connected to a shower curtain, and slid along the shower rod;

wherein one of: (1) the first outer shower ring, and (2) the first outer end of the shower rod or the mounting assembly, includes a first magnet;

wherein the other of: (1) the first outer shower ring, and (2) the first outer end of the shower rod or the mounting assembly, includes a second magnet or a magnetically attractable material; and wherein the shower curtain is maintained in place along the opposing shower enclosure walls by attraction of the first magnet of one of: (1) the first outer shower ring, and (2) the first outer end of the shower rod or the mounting assembly, to the second magnet or the magnetically attractable material of the other of: (1) the first outer shower ring, and (2) the first outer end of the shower rod or the mounting assembly.

2. The magnetic shower curtain system of claim 1, wherein:

the mounting assembly includes a shower rod cover;

the shower rod cover is operable to cover one of the opposing ends of the shower rod; and the shower rod cover includes one of: (1) the first magnet, and (2) the second magnet or the magnetically attractable material.

3. The magnetic shower curtain system of claim 1, wherein:

the mounting assembly includes a mounting bracket;

the mounting bracket is operable to be connected to one of the opposing shower enclosure walls; and the mounting bracket includes one of: (1) the first magnet, and (2) the second magnet or the magnetically attractable material.

4. The magnetic shower curtain system of claim 1, wherein the first outer shower ring includes the first magnet and the first outer end of the shower rod includes the second magnet.

5. The magnetic shower curtain system of claim 1, wherein the first outer shower ring includes the first magnet and the first outer end of the shower rod includes the magnetically attractable material.

6. The magnetic shower curtain system of claim 1, wherein the first outer shower ring includes the magnetically attractable material and the first outer end of the shower rod includes the first magnet.

7. The magnetic shower curtain system of claim 1, wherein the first outer shower ring includes the first magnet and the mounting assembly includes the second magnet.

8. The magnetic shower curtain system of claim 1, wherein the first outer shower ring includes the first magnet and the mounting assembly includes the magnetically attractable material.

9. The magnetic shower curtain system of claim 1, wherein the first outer shower ring includes the magnetically attractable material and the mounting assembly includes the first magnet.

10. A magnetic shower curtain system, comprising:

a shower rod assembly, the shower rod assembly including a shower rod, the shower rod operable to be mounted between opposing shower enclosure walls, the shower rod including a first outer end and a second outer end;

a mounting assembly, the mounting assembly including at least one of a mounting bracket and a shower rod cover, the mounting assembly operable to be mounted on one of the opposing shower enclosure walls; and a shower curtain assembly, the shower curtain assembly including a first outer shower ring, the first outer shower ring operable to be placed on the shower rod, connected to a shower curtain, and slid along the shower rod;

wherein one of: (1) the first outer shower ring, and (2) the first outer end of the shower rod or the mounting assembly, includes a first magnet;

wherein the other of: (1) the first outer shower ring, and (2) the first outer end of the shower rod or the mounting assembly, includes a second magnet or a magnetically attractable material; and wherein the shower curtain is maintained in place along the opposing shower enclosure walls by attraction of the first magnet of one of: (1) the first outer shower ring, and (2) the first outer end of the shower rod or the mounting assembly, to the second magnet or the magnetically attractable material of the other of: (1) the first outer shower ring, and (2) the first outer end of the shower rod or the mounting assembly.

11. The magnetic shower curtain system of claim 10, wherein:

the mounting assembly includes the shower rod cover;

the shower rod cover is operable to cover one of the opposing ends of the shower rod; and the shower rod cover includes one of: (1) the first magnet, and (2) the second magnet or the magnetically attractable material.

12. The magnetic shower curtain system of claim 10, wherein:

the mounting assembly includes the mounting bracket;

the mounting bracket is operable to be connected to one of the opposing shower enclosure walls; and the mounting bracket includes one of: (1) the first magnet, and (2) the second magnet or the magnetically attractable material.

13. The magnetic shower curtain system of claim 10, wherein the first outer shower ring includes the first magnet and the first outer end of the shower rod includes the second magnet.

14. The magnetic shower curtain system of claim 10, wherein the first outer shower ring includes the first magnet and the first outer end of the shower rod includes the magnetically attractable material.

15. The magnetic shower curtain system of claim 10, wherein the first outer shower ring includes the magnetically attractable material and the first outer end of the shower rod includes the first magnet.

16. The magnetic shower curtain system of claim 10, wherein the first outer shower ring includes the first magnet and the mounting assembly includes the second magnet.

17. The magnetic shower curtain system of claim 10, wherein the first outer shower ring includes the first magnet and the mounting assembly includes the magnetically attractable material.

18. The magnetic shower curtain system of claim 10, wherein the first outer shower ring includes the magnetically attractable material and the mounting assembly includes the first magnet.

19. A magnetic shower curtain system, comprising:

a shower rod assembly, the shower rod assembly including a shower rod, the shower rod operable to be mounted between opposing shower enclosure walls, the shower rod including a first outer end and a second outer end;

a mounting assembly, the mounting assembly including a mounting bracket and a shower rod cover, the mounting bracket operable to be connected to one of the opposing shower enclosure walls, the shower rod cover operable to cover the first outer end of the shower rod; and a shower curtain assembly, the shower curtain assembly including a first outer shower ring, the first outer shower ring operable to be placed on the shower rod, connected to a shower curtain, and slid along the shower rod;

wherein one of: (1) the first outer shower ring, and (2) the first outer end of the shower rod or the mounting assembly, includes a first magnet;

wherein the other of: (1) the first outer shower ring, and (2) the first outer end of the shower rod or the mounting assembly, includes a second magnet or a magnetically attractable material; and wherein the shower curtain is maintained in place along the opposing shower enclosure walls by attraction of the first magnet of one of: (1) the first outer shower ring, and (2) the first outer end of the shower rod or the mounting assembly, to the second magnet or the magnetically attractable material of the other of: (1) the first outer shower ring, and (2) the first outer end of the shower rod or the mounting assembly.

20. The magnetic shower curtain system of claim 19, wherein one of the mounting bracket and the shower rod cover includes the second magnet or the magnetically attractable material.

* * * * *